US006144000A

United States Patent [19]

Webb

[11] Patent Number: 6,144,000

[45] Date of Patent: Nov. 7, 2000

[54] ROBUST SWITCH ASSEMBLY

[76] Inventor: Thomas J. Webb, 15 Hearn La., Hamden, Conn. 06514

[21] Appl. No.: 09/413,976

[22] Filed: Oct. 7, 1999

Related U.S. Application Data

[60] Provisional application No. 60/102,809, Oct. 2, 1998.

[51] Int. Cl.[7] ..... H01H 9/00

[52] U.S. Cl. ..... 200/302.1; 200/520; 200/573; 200/341

[58] Field of Search ..... 260/16 R–16 C, 260/520, 293, 302.1, 302.2, 329, 341, 17 R, 534, 535, 573

[56] References Cited

U.S. PATENT DOCUMENTS

| | | | |
|---|---|---|---|
| 4,053,726 | 10/1977 | Schaad | 200/159 R |
| 4,434,330 | 2/1984 | Geremia | 200/67 DA |
| 4,965,420 | 10/1990 | Phillips et al. | 200/341 |
| 5,302,789 | 4/1994 | Hellman, Sr. et al. | 200/461 |
| 5,497,133 | 3/1996 | Dawson et al. | 335/83 |
| 5,647,117 | 7/1997 | Kurita | 29/622 |

*Primary Examiner*—Michael Friedhofer
*Attorney, Agent, or Firm*—Paul R. Webb, II

[57] ABSTRACT

A robust switch assembly has a support structure with a hermetically sealed high temperature switch secured to it. A high temperature current conductor is within the switch. A spring is in contact with the switch and with the plunger of a plunger mechanism. A lead wire assembly extends from the opposite end of the switch.

6 Claims, 1 Drawing Sheet

ROBUST SWITCH ASSEMBLY

This application claims the benefit of the U.S. Provisional application Ser. No. 60/102,809, filed Oct. 2, 1998.

BACKGROUND OF THE INVENTION

1. Technical Field

This invention relates to a high temperature, hermetically sealed electric switch assembly and more particularly to such a switch assembly useful in electromechanical functions in which discrete electrical signals correspond to a function of mechanical motion.

2. Background Information

A high temperature, hermetically sealed electrical switch assembly is useable in many electromechanical functions in which discrete electrical signals correspond to a function of mechanical motion. Such switch assemblies are utilized in aircraft pneumatic bleed air valve assemblies. Such valves are utilized in aircraft as a means of sensing and controlling pneumatic pressure relative to aircraft system demands. Reliable indication of valve opening and closing is essential to correct system feedback and reliable system operation.

Previous designs were limited to 700 degree Fahrenheit continuous temperature rating and 75- degree F. intermittent operation rating. These switches perform marginally in the rugged environments found of modem aircraft.

The pneumatic system switches can be in close proximity to the 1200 degree F. airflow, although cooling air moderates the ambient air temperature to approximately 1000 degrees F. Typical aircraft applications are extremely demanding in that there can be significant levels of vibration and temperature present along with damaging chemicals that range from fuels and oils to chemical cleaners. Design limitations of prior switch assemblies caused operational problems. The primary problem is the inability of the aircraft controlling systems to accurately determine if the pneumatic system bleed air valves are correctly positioned. This causes system anomalies and excessive maintenance by the aircraft operators. At sporadic intervals, the electrical switch assembly performance shifts past the point to which the component can be adjusted, and the switch assembly has to be replaced.

Design limitations of previous electrical switch assembly designs causes several technical problems. The primary problem is the bleed air system is using a changing or inaccurate reference switch position. A secondary problem occurs when the incorrect valve position setting, which varies from switch to switch, results in aircraft pneumatic systems responding to valve indication signals that lack the necessary accuracy and precision.

Thus, there exists a need for a robust switch assembly.

SUMMARY OF THE INVENTION

Briefly, the present invention satisfies the need for a robust switch assembly.

The present invention provides a support structure with a hermetically sealed high temperature switch secured thereto. A high temperature silver alloy conducts current at elevated temperatures within the switch. A glass seal is provided to seal the switch. A leaf spring is secured to the switch. A plunger mechanism actuates the leaf spring.

These and other features and advantages of this invention will become apparent from the following detailed description of the various aspects of the invention taken in conjunction with the accompanying drawing.

BEST MODE FOR CARRYING OUT THE INVENTION

Figure 1:
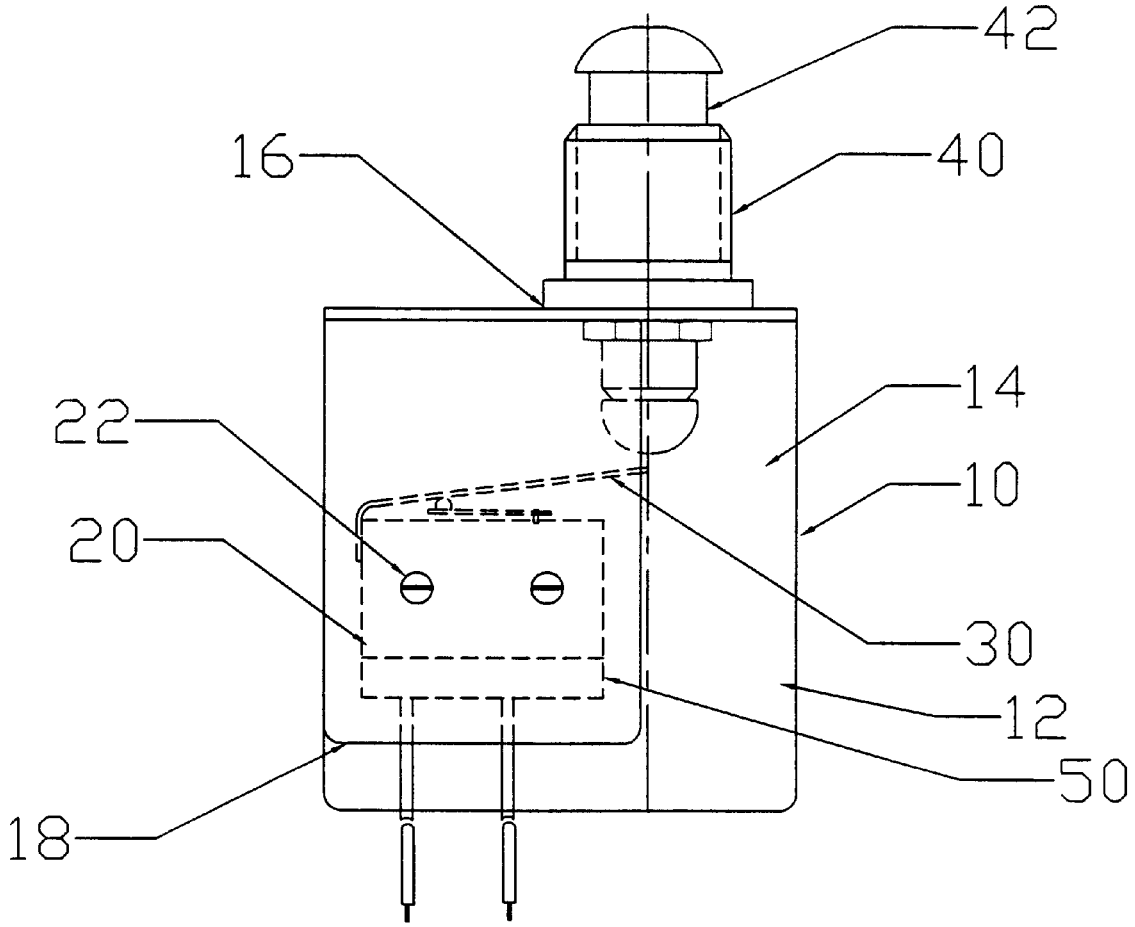
FIG. 1 is a side elevational schematic view of a robust switch assembly in accordance with the present invention.

FIG. 1 shows a robust switch assembly 10 in accordance with the present invention. Assembly 10 has a support structure 12 with a first side portion 14, a top portion 16 and a second side portion 18. A hermetically sealed switch 20 has the capability of operating at 1000 degrees F. Various high temperature capable cobalt alloys, nickel alloys and titanium compounds are used to achieve repeatable switch characteristics at 1000 degrees F. Switch 20 is shown as secured to the second side portion 18 of support structure 12 by means of two screws 22. A high temperature electrical current conductor (not shown) employs high temperature silver alloys. One end of an Inconel leaf spring 30 is in contact with switch 20. A plunger mechanism 40 is secured to top portion 16 of support structure 12. A stainless steel plunger 42 is positioned within plunger mechanism 40. The lower portion of plunger 42 contacts and is adapted to depress the other end of leaf spring 30. Within plunger mechanism 40 is a cobalt alloy spring (not shown). Spring 30 is designed to allow continuous 1000 degree F. compression without significant changes in properties. Plunger mechanism 40 is designed to eliminate loading, and vibration induced related wear. At the opposite end of switch 20 various glass alloys are used to seal switch 20. To eliminate the inconsistencies of currently available electrical switch assemblies, a robust switch assembly was developed and tested to higher temperatures, higher vibration levels, and harsh environmental requirements. Extensive testing produced an extremely capable hermetically sealed electric switch assembly that will reproduce the original reference settings for extended periods of time. Unlike existing designs, which use materials that change properties with time, adversely affecting component accuracy, the new design uses higher temperature materials that are not significantly affected. These materials were selected to within stand 1000 degree F. temperatures and rugged environments such as aircraft engines.

After scientifically analyzing the environmental requirements of the intended installation, the electrical switch assembly is designed to exceed environmental conditions, and reference setting changes to the electrical switch assembly are eliminated. The present invention thereby overcomes the previous problems by reproducing the original reference settings for extended periods of time.

While specific embodiments of the present invention have been described it will be apparent to those skilled in the art that various modifications thereto can be made without departing from the spirit and scope of the invention as defined in the appended claim.

What I claim is:

1. A robust switch assembly comprising a support structure, a hermetically sealed high temperature switch secured to said support structure, a high temperature current conductor within said switch, one end of a high temperature leaf spring in contact with said switch, a plunger mechanism secured to said support structure, a plunger in said mechanism used to activate or release said spring, and a lead wire assembly contacting said current conductor and extending from said switch.

2. The robust switch assembly of claim 1 wherein said current conductor is a silver alloy.

3. The robust switch assembly of claim 1 wherein said leaf spring in Inconel.

4. The robust switch assembly of claim 1 wherein said plunger is stainless steel.

5. The robust switch assembly of claim 1 wherein a glass alloy seals said switch.

6. A robust switch assembly comprising a support structure, a hermetically sealed high temperature switch secured to the support structure, a high temperature silver alloy current conductor within said switch, one end of a high temperature Inconel leaf spring in contact with said switch, a plunger mechanism secured to said support structure, a stainless steel plunger in said mechanism set to activate or release said spring, a glass alloy sealing said switch, and a lead wire assembly contacting said current conductor and extending from the glass seal.

* * * * *